US012017740B2

(12) United States Patent
Plummer et al.

(10) Patent No.: US 12,017,740 B2
(45) Date of Patent: Jun. 25, 2024

(54) BOAT TRANSPORT DEVICE

(71) Applicants: James Plummer, Elma, WA (US); Penny Ramstein, Elma, WA (US)

(72) Inventors: James Plummer, Elma, WA (US); Penny Ramstein, Elma, WA (US)

( * ) Notice: Subject to any disclaimer, the term of this patent is extended or adjusted under 35 U.S.C. 154(b) by 407 days.

(21) Appl. No.: 17/489,893

(22) Filed: Sep. 30, 2021

(65) Prior Publication Data

US 2023/0032404 A1 Feb. 2, 2023

Related U.S. Application Data

(60) Provisional application No. 63/226,446, filed on Jul. 28, 2021.

(51) Int. Cl.
*B63C 13/00* (2006.01)
*B63B 34/26* (2020.01)

(52) U.S. Cl.
CPC ..... *B63C 13/00* (2013.01); *B63B 34/26* (2020.02)

(58) Field of Classification Search
CPC ..... B63C 13/00; B63B 34/26
See application file for complete search history.

(56) References Cited

U.S. PATENT DOCUMENTS 1,002,661 A * 9/1911 Erikson ..... B63C 13/00 114/344
1,939,863 A * 12/1933 Seiter ..... B63C 13/00 114/344
2,042,598 A * 6/1936 Harvey ..... B63C 13/00 280/80.1
2,294,110 A * 8/1942 Donaldson ..... B63C 13/00 280/80.1
2,929,079 A * 3/1960 Totten ..... B63C 13/00 114/344
3,035,282 A * 5/1962 Bemis ..... B63C 13/00 114/344
3,337,229 A * 8/1967 Raymond ..... B63C 13/00 280/47.32
4,830,387 A * 5/1989 Batten ..... B63C 13/00 280/38

* cited by examiner

*Primary Examiner* — Anthony D Wiest
(74) *Attorney, Agent, or Firm* — Brennan, Manna & Diamond, LLC

(57) ABSTRACT

The present invention relates generally to the field of boat transports or carriers which may be mounted to a sidewall of the boat by a bracket. The carrier has a frame and a wheel assembly that has a horizontal cross member, a first vertical fork, a second vertical fork, a mounting bracket and a wheel. An individual may place two boat-mounted brackets on to opposing sides of a boat, so that the user may easily wheel the boat to the desired location. Once at the location, the user can then remove each wheel assembly and use the boat as normal.

12 Claims, 5 Drawing Sheets

BOAT TRANSPORT DEVICE

CROSS-REFERENCE TO RELATED APPLICATION

The present application claims priority to, and the benefit of, U.S. Provisional Application No. 63/226,446, which was filed on Jul. 28, 2021, and is incorporated herein by reference in its entirety.

FIELD OF THE INVENTION

The present invention relates generally to the field of personal watercraft transport device. More specifically, the present invention relates to a boat, such as a canoe, kayak, rowboat, paddle boat or the like transport device. The invention includes a boat-mounted bracket and a wheel assembly that has a horizontal cross member, a first vertical fork and a second vertical fork, a mounting bracket and at least one wheel. In the preferred embodiment, a user may place two boat-mounted brackets on to each opposing side of a boat, with each bracket containing a cylindrical protrusion that engages separate wheel assemblies. To this effect, a user can then attach each wheel assembly to different side surfaces of the boat and wheel the boat to the desired location. Once at the location, the user can then remove each wheel assembly and use the boat as normal. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Many individuals frequently enjoy fishing and boating as part of a leisure time activity. However, if a user is not on a property that is immediately adjacent to a body of water, the user normally must trailer his or her boat to the body of water in order to boat, fish or engage in other activities. The trailering process involves unloading a boat from a trailer, vehicle bed, or other carrier that is usually connected to a vehicle into a body of water. When the boat is on a trailer, vehicle, or other carrier, the trailer/vehicle/carrier is typically backed down a boat ramp. On crowded bodies of water, the boat ramp that is used to enter the water is often equally as crowded, such that individuals must wait undesirable periods of time to launch their boat from their trailer via the ramp. In order to avoid this waiting period, a user may attempt to physically carry their boat (such as a small aluminum fishing boat or canoe) to the body of water and access the water from another suitable area on the shoreline. However, this process normally involves more than one person, and is often unachievable with only one individual, as small boats are also often stocked with fishing or other boating supplies, such as coolers, life jackets and the like, that would otherwise take multiple trips to carry to the boat. Therefore, if an individual does not have a multitude of other individuals to aid the user in carrying the boat, the user cannot avoid the undesirable wait at a boat ramp or multiple trips back and forth in order to adequately provision the boat prior to the trip.

Motorized trailer-moving devices are known in the art and can be used to move a trailered boat. However, the trailer-moving devices only attach to the trailer, and not the boat itself. In this regard, there may be certain scenarios wherein a trailer is too large or heavy to be moved close enough to a body of water to launch a boat, especially if the launching location is not a boat ramp and has unstable ground. Further, existing trailer-moving devices often require fuel which may run out at any time, thereby requiring a user to refill the device to continue using it, which may be inconvenient and undesirable. In addition, an individual may have to wait for the trailer-moving device during a weekend or other holiday, where crowds may have gathered around the body of water and need their boats launched as well.

Therefore, there exists a long-felt need in the art for an improved boat transport or personal handling device. There also exists in the art a long-felt need for a boat transport or handling device that allows a single user to easily transport a boat from a trailer, vehicle bed, or other carrier to a body of water without requiring a user to move the trailer, vehicle, or other carrier itself. In addition, there exists a long-felt need in the art for a boat transport or personal boat-handling device that does not rely on fuel or any other additional powering means, but that also allows a single user to easily maneuver a small boat that is full of boating or fishing supplies. Finally, there is a long-felt need in the art for a boat transport or personal boat handling carrier that can be easily removed from a boat after the boat has been transported to its desired location in or near a body of water.

The subject matter disclosed and claimed herein, in one embodiment thereof, comprises a boat transport device or personal boat-handling carrier having a boat-mounted bracket member and a wheel assembly with a horizontal cross member, a first vertical fork, a second vertical fork, a mounting bracket and at least one wheel. In the preferred embodiment, a user may place two boat-mounted brackets on to each of the opposing sides of a boat. Each bracket member contains a cylindrical protrusion that engages a mounting bracket on each wheel assembly. In this way, a user can then attach each wheel assembly to opposing side surfaces of the boat and wheel the boat to the desired location. Once at the location, the user can then remove each wheel assembly, if more than one assembly is provided, and use the boat as normal.

In this manner, the boat transport device of the present invention accomplishes all of the forgoing objectives and provides an improved device that allows a single individual to easily transport a small boat using a personal boat handling carrier to a body of water without requiring the individual to move a traditional trailer, vehicle, or other carrier itself. The device also does not rely on fuel or any other additional powering means or require an individual to wait for the availability of the boat ramp or trailer moving device, yet still allows a single user to easily maneuver a boat that is full of boating or fishing supplies. Finally, the device can be easily removed from a boat after the boat has been transported to its desired location.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a boat transport device or personal boat-handling carrier that has a boat-mounted bracket member and a wheel assembly that has a horizontal cross member, a first vertical fork, a second vertical fork, a mounting bracket and at least one wheel. In a preferred embodiment, an individual may place two boat-mounted bracket members on to each of the opposing sides of a boat. Each bracket member contains a cylindrical protrusion and each protrusion further engages a cutout in a mounting bracket that is fixedly-attached to the wheel assembly. In an attached position, the weight of the boat presses the cylindrical protrusions down against the cutouts of the mounting bracket such that the weight of the boat is distributed throughout the wheel assembly. The first vertical fork and the second vertical fork are also fixedly-attached to and are supported by a horizontal cross member. The bottom portion of each fork can receive a wheel axle and an attached wheel. In this manner, a boat will preferably have one wheel assembly on each of its two opposing side surfaces, such that there is a wheel on each side of the boat to allow the boat to be easily transported and moved to the area for launching the boat.

The wheel assembly has a fixedly-attached vertical support that extends upward and away from the horizontal cross member and towards the removable oar holder bracket that is commonly found of the top surface of small fishing or rowboats. The vertical support has a horizontal bracket with an opening that can receive the oar bracket, such that the shaft of the bracket can be placed through the opening and back into the side surface of the boat to anchor the wheel assembly to the boat. This securing mechanism further provides stability while the device and boat are in motion. In addition, the wheel assembly can be easily removed from the boat by simply lifting the oar holder from the boat and removing the wheel assembly from the boat by tilting the weight of the boat to one side and pressing downwards on the mounting bracket, such that the lack of weight from the boat and gravity allow the bracket to separate from the cylindrical protrusion.

The present invention may also include a method of using the boat transport device or personal boat handling carrier to move a boat, such as a rowboat, canoe, kayak, paddle boat, sailboat, catamaran or other personal craft, that has commonly been stored on a trailer or a vehicle bed. First, at least one boat-mounted bracket member is installed on the two opposing side surfaces or sidewalls of a boat or watercraft. Then, both oar holders of the boat are removed, and the wheel assembly is positioned on each side of the boat, such that the opening of the horizontal bracket is positioned above the opening in the top surface of the boat that receives the oar holder. Next, the mounting bracket of the wheel assembly is positioned such that the cylindrical protrusion contacts the bottom of the cutout. Then, the oar holders are replaced such that the stem of the oar holders is placed through the opening of each bracket, and the wheel assembly is secured to the boat on each side. The boat can then be picked up and removed from the trailer, and the wheel of each wheel assembly contacts the ground suspending the boat from the ground. After the boat has been fully removed from the trailer, the boat can then be transported to a desired location by being pushed or pulled by one or more individuals. After the boat has reached the desired location, one oar holder can be removed, and after tilting the boat to one direction, the force of gravity and downward pressure from a user can be used to free the wheel assembly from the mounting bracket to allow the assembly to be removed. Finally, the previous step can be repeated to remove the other assembly from the other side of the boat.

Accordingly, the boat transport device of the present invention is particularly advantageous as it allows an individual to easily transport a small boat from a personal boat handling carrier to a body of water, without requiring a user to move a traditional trailer itself, or requiring trailer movement assists. Further, the device does not rely on fuel or any other additional powering means while still allowing an individual to easily maneuver a boat that is full of equipment, boating or fishing supplies. Finally, the personal boat handling carrier can be easily removed from a boat after the boat has been transported to its desired location.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
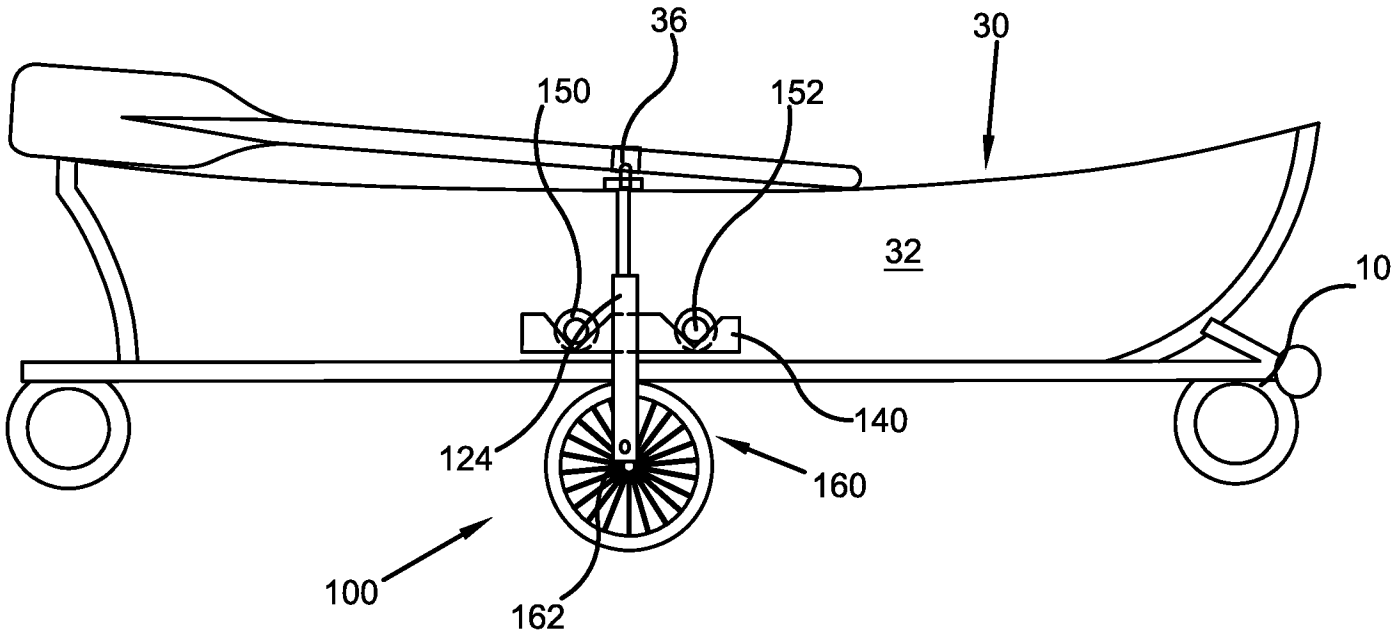
FIG. 1 illustrates a side perspective view of one potential embodiment of a boat transport device or personal boat handling carrier of the present invention attached to a boat that is being stored on a trailer in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown.

Thus, in other embodiments, any of the features described herein from different embodiments may be combined.

As noted above, there is a long-felt need in the art for a boat transport device or personal boat handling carrier that allows an individual to easily transport a personal watercraft such as a canoe, kayak, rowboat, paddleboat or the like from a conventional boat trailer, vehicle bed, or other carrier to a body of water, without requiring the individual to move the conventional trailer itself. There also exists a long-felt need in the art for a boat transport device or personal boat handling carrier that does not rely on fuel or any other additional powering means other than the power of the user or trailer assist. Further, there exists a long-felt need in the art for a boat transport device or personal boat handling carrier that allows an individual to easily maneuver a boat full of equipment, boating or fishing supplies. Finally, there is a long-felt need in the art for a boat transport device or personal boat handling carrier that can be easily removed from a boat after the boat has been transported to its desired location.

The present invention, in one exemplary embodiment, is comprised of a boat transport device or personal boat handling carrier that has a boat-mounted bracket member and at least one wheel assembly that has a horizontal cross member, a first vertical fork, a second vertical fork, a mounting bracket and a wheel. In the preferred embodiment, a user may place more than one boat-mounted bracket members on to each opposing side of a boat, as well as the front or back of the boat, Each bracket member contains a cylindrical protrusion and ach protrusion further engages a cutout in a mounting bracket that is fixedly-attached to the wheel assembly, such that the weight of the boat presses the cylindrical protrusions down against the cutouts of the mounting bracket to distribute the weight of the boat throughout the wheel assembly. The first vertical fork and the second vertical fork are also fixedly attached to and are supported by a horizontal cross member and the bottom portion of each fork can receive a wheel axle and attached wheel. Therefore, in one embodiment a boat or other personal watercraft will have one wheel assembly on each of its two opposing side surfaces such that there is a wheel assembly on each side of the boat that allows the boat to be easily transported.

In addition, the wheel assembly has a fixedly-attached vertical support that extends upward and away from the horizontal cross member and towards the removable oar holder bracket that is commonly found of the top surface of small fishing boats such as rowboats. The vertical support has a horizontal bracket with an opening that can receive the bracket, so that the bracket can be placed through the opening and back into the side surface of the boat to anchor the wheel assembly to the boat and to provide stability while the device and boat are in motion while transporting the watercraft. Further, the wheel assembly can be easily removed from the watercraft by simply lifting the oar holder from the boat and removing the wheel assembly from the boat by tilting the weight of the boat to one side and pressing downwards on the mounting bracket, such that the lack of weight from the boat and gravity allow the bracket to separate from the cylindrical protrusion.

The present invention may also include a method of using the boat transport device or personal boat handling carrier to move a boat or personal watercraft that is stored on a conventional trailer. First, at least one boat-mounted bracket member is installed on the two opposing side surfaces or sidewalls of the boat. Then, both oar holders of the boat are removed and the wheel assembly is positioned on each side of the boat, such that the opening of the horizontal bracket is positioned above the opening in the top surface of the boat that receives the oar holder. Next, the mounting bracket of the wheel assembly is positioned such that the cylindrical protrusion contacts the bottom of the cutout. Then, the oar holders are replaced such that the stem of the oar holders are inserted through the opening of each bracket, and the wheel assembly is secured to the boat on each side. The boat can then be picked up by an individual and removed from the trailer, and the wheel of each wheel assembly supports the boat and is in contact with the ground. After the boat has been fully removed from the trailer, the boat can then be transported to a desired location by being pushed or pulled by one or more individuals. After the boat has reached the desired location, one oar holder can be removed and after tilting the boat to one direction the force of gravity and downward pressure from the individual can be used to free the wheel assembly from the mounting bracket to allow the assembly to be removed. Finally, the previous step can be repeated to remove the other assembly from the other side of the boat.

Accordingly, the boat transport device of the present invention is particularly advantageous as it allows a single individual to easily transport or move a small boat from a trailer or storage area to a body of water without requiring the individual to move the trailer itself or requiring multiple other users to transport the boat. Further, the device does not rely on fuel or any other additional powered devices while still allowing an individual to easily maneuver a boat that is full of equipment, boating or fishing supplies. Finally, the device can be easily removed from a boat after the boat has been transported to its desired location.

Figure 3:
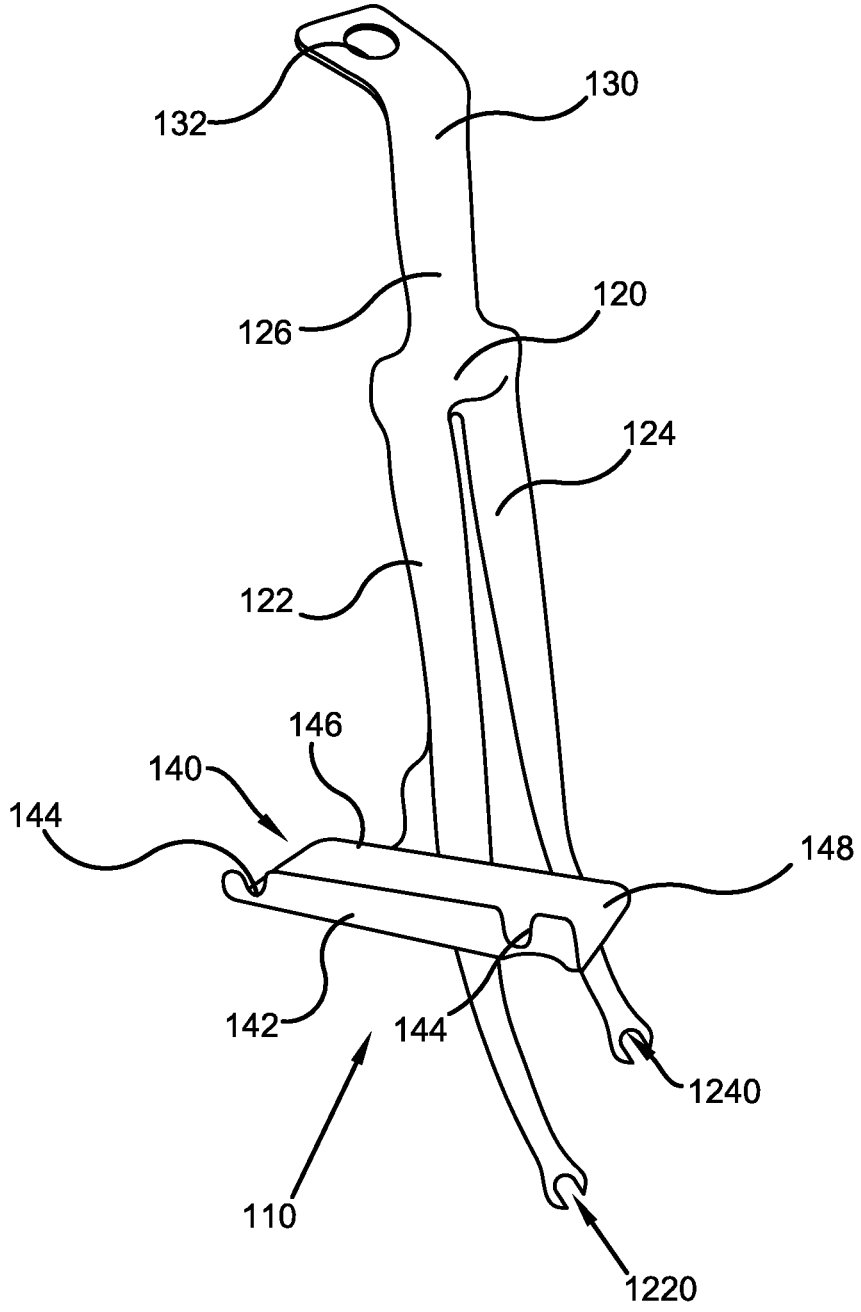
FIG. 3 illustrates a rear perspective view of one potential embodiment of a boat transport device or personal boat handling carrier of the present invention in accordance with the disclosed architecture.

Referring initially to the drawings, FIG. 1 illustrates a side perspective view of one potential embodiment of a boat transport device or personal boat handling carrier 100 of the present invention attached to a boat 30 that is being stored on a conventional trailer 10 in accordance with the disclosed specification. FIG. 3 shows the carrier or transport device 100 has a boat-mounted bracket member 150 and a wheel assembly 110 that has a horizontal cross member 120, a first vertical fork 122 and a second vertical fork 124, a mounting bracket 140 and a wheel 160. The first and second vertical forks 122 and 124 have an arcing portion below the mounting bracket 140. It is contemplated that unless otherwise stated, all of the components of the device 100 (less the rubber tire portion of the wheel 160) are manufactured from a durable material, like metal such as stainless steel, aluminum or carbon fiber to provide a lightweight structure for ease of movement and storage. Further, all components of the device 100 may have a waterproof/water-resistant coating and/or a rust-proof coating.

Figure 2:
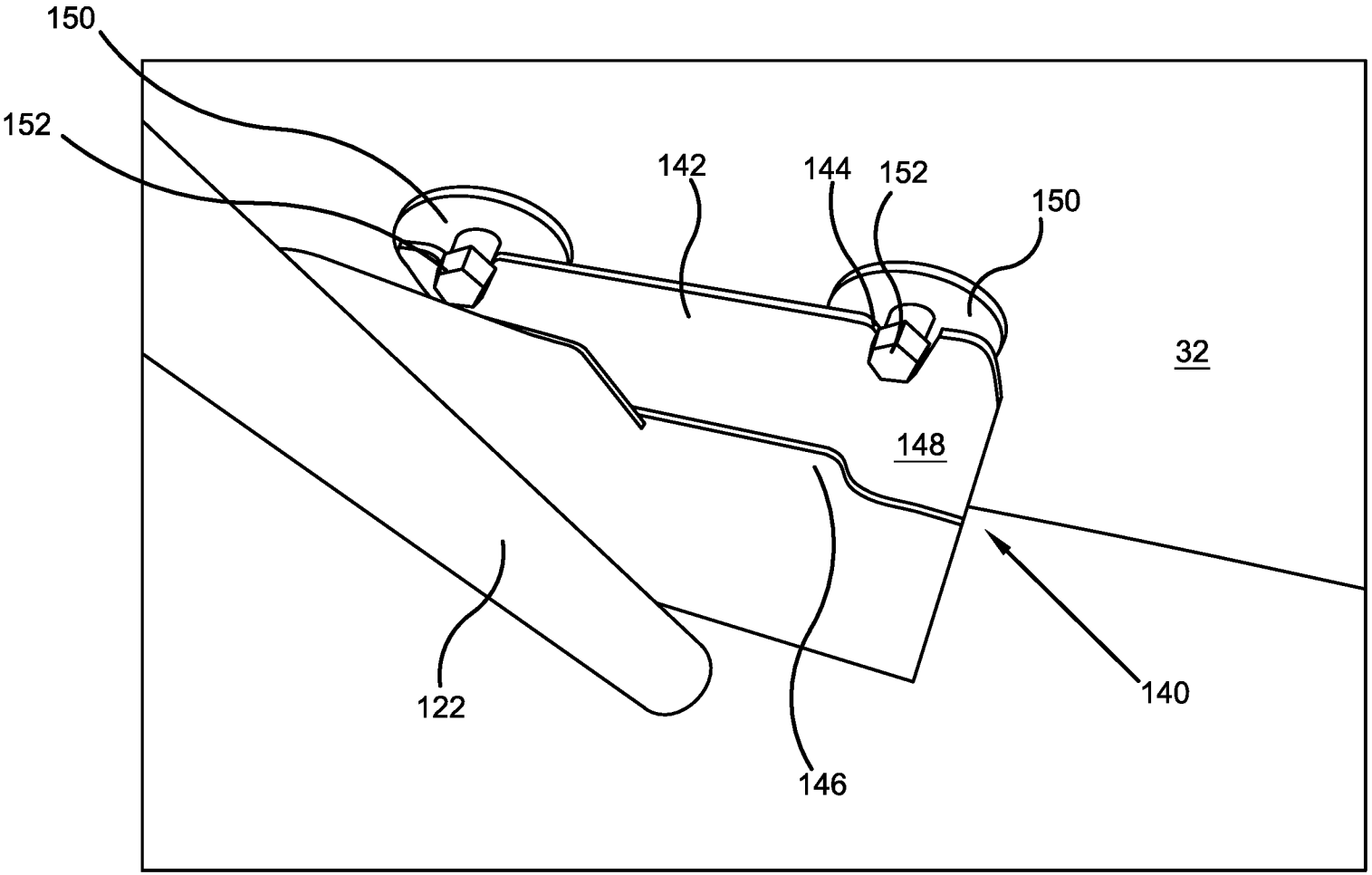
FIG. 2 illustrates an enhanced perspective view of one potential embodiment of a mounting bracket of the boat transport device or personal boat handling carrier of the present invention in accordance with the disclosed architecture.

The wheel assembly 110 can further be easily attached to the side surface 32 of a boat 30 when the boat 30 is still on a trailer 10. In differing embodiments of the device 100, the device 100 may come in a kit of multiple carriers 100 that can be positioned on the various side surfaces 32 of a boat 30 as desired or needed to move the boat. As noted, the device 100 is most optimally used by placing one device 100 on each of the two main side surfaces 32 of a boat 30. However, it is to be appreciated that a user may utilize any number of carrier assists 100 on many surfaces of a boat or watercraft 30 depending on the weight, size and shape of the boat or craft 30. In order to allow the wheel assembly 110 to attach to the side surface 32 of a boat 30, a boat-mounted bracket member 150 must first be installed on the side surface 32 as best seen in FIG. 2. It is contemplated that the member 150 is generally circular in shape, but in differing embodiments may be any shape as is known in the art such as, but not limited to, square, rectangular, triangular, etc., and may be designed in order to fit the side wall area of the craft 30. Further, the member 150 is preferably fixedly-attached to the side surface 32 via welds, industrial adhesive, fasteners or combinations thereof or removably-attached via secure fasteners such as nuts, bolts, screws, etc. In the preferred embodiment of the device 100, there are two boat-mounted members 150 per device 100. The two separate members 150 allow for the attachment of one wheel assembly 110. However, in differing embodiments, the number of boat-mounted members 150 may be as little as at least one, and as large in number as necessary, for example depending on the length of the boat there may be multiple carriers or assists on each side of the boat. Further, it is contemplated that in one embodiment, one boat-mounted member 150 may contain multiple members 150 upon one solid piece of continuous material.

The member 150 is further comprised of a fixedly or removably-attached cylindrical protrusion 152 that engages the mounting bracket 140 of the wheel assembly 110. The mounting bracket 140 spaces the wheel a distance from the sidewall of the boat, so as to allow the wheel the ability to move when the frame is secured to the boat. The mounting bracket 140 extends perpendicularly from the pair of arms. As best seen in FIG. 3 which illustrates a rear perspective view of the boat transport device 100, the mounting bracket 140 is preferably located behind each fork 122, 124 and has a first side wall 142, a second side wall 146 that is fixedly-attached to the first fork 122, and a bottom wall 148. The first side wall 142 further includes at least one cutout 144 that may be any shape or contour such that it can receive the cylindrical protrusion 152 of the boat-mounted member 150. It is contemplated that in differing embodiments, the first side wall 142 may have any number of cutouts 144, where the number of cutouts corresponds to the number of cylindrical protrusions 152 of the device 100. In an attached position, the weight of the boat 30 presses the cylindrical protrusions 152 down against the cutouts 144 of the first side wall 142, such that the weight of the boat 30 is distributed throughout the wheel assembly 110. Alternatively, some or all of the weight may be transferred to the vertical support 126 that rests below the lip of the boat 30. Further, in one embodiment the cylindrical protrusion 152 may be in the form of a fastener such as a nut, screw or bolt that has been permanently or removably-installed into the side surface 32 of a boat 30 through the boat-mounted member 150.

As also seen in FIG. 1 and FIG. 3, the wheel assembly 110 is comprised of a first vertical fork 122 and a second vertical fork 124, that are fixedly-attached to and supported by a horizontal cross member 120. The bottom portion of each fork 122, 124 may have a slot 1220, 1240 to receive the axle 162 of a wheel 160. In differing embodiments, the wheel 160 may be fixedly or removably-attached to the axle 162, and the axle 162 may be fixedly or removably-attached to both forks 122, 124, via any fastening or locking system known in the art such as nuts, bolts, screws, etc. Further, in differing embodiments, the wheel 160 may have a tire of various sizes, widths and treads that is made of a rubber or other composite material that may further be a traditional air-filled tired or a run-flat tire. Similarly, the space between each fork 122, 124 may be such that any desired tire and wheel 160 size can be accommodated. In order to most optimally use the device 100, it is contemplated that a user places one device 100 on each side surface 32 (e.g. two devices 100) of a boat 30 such that the wheels 160 can evenly support the weight of the boat 30 and move it accordingly, as noted supra. However, a user may apply as many devices 100 to as many surfaces 32 of a boat 30 as desired, depending on the size, length, width and weight distribution of the boat 30.

Figure 4:
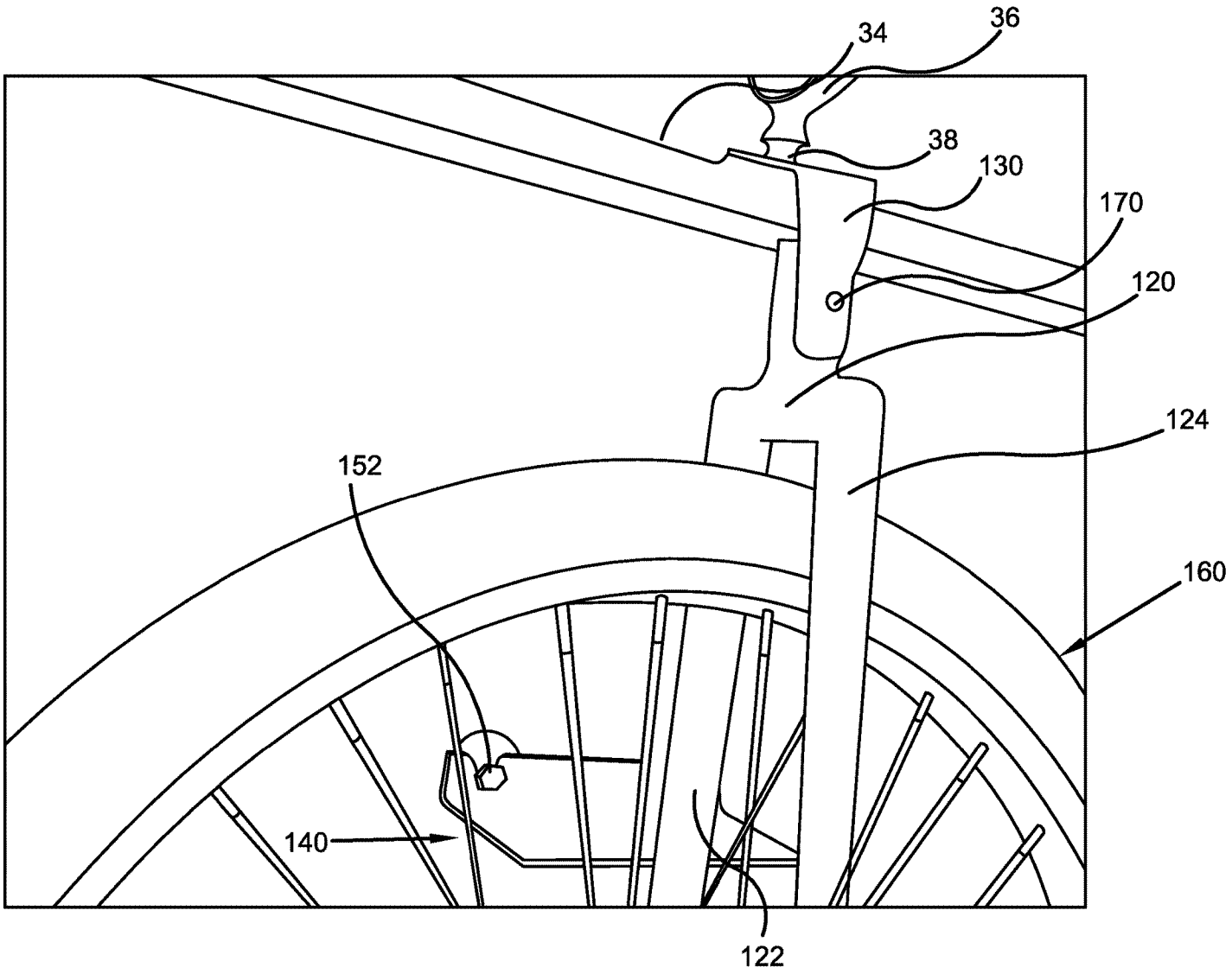
FIG. 4 illustrates an enhanced perspective view of one potential embodiment of a boat transport device or personal boat handling carrier of the present invention in accordance with the disclosed architecture.

The wheel assembly 110 further includes a fixedly-attached vertical support 126 that extends upward and away from the horizontal cross member 120 and towards the oar holder bracket 36 that is commonly found on the top surface 34 of most small fishing boats 30. The vertical support 126 has a horizontal L-bracket 130 with an opening 132 that can receive the shaft 38 of the bracket 36, such that the shaft 38 is placed through the opening 132 and back into the side surface 32 of the boat, as shown in FIG. 4. In this manner, the oar holder 36 semi-permanently anchors the wheel assembly 110 to the boat 30 and provides stability to the wheel assembly 110 while the device 100 and boat 30 are in motion. The wheel assembly is positioned so that only a portion of the wheel needs to be below the boat, so that the boat may be easily pushed or pulled. However, this method of attachment allows the wheel assembly 110 to be easily removed from the boat 30 by simply lifting the oar holder 36 from the boat 30 and removing the wheel assembly 110 from the boat 30 by tilting the weight of the boat 30 to one side, and pressing downwards on the mounting bracket 140 such that the lack of weight from the boat 30 and gravity allow the bracket 140 to separate from the cylindrical protrusion 152. In differing embodiments, the bracket 130 may be fixedly-attached to the vertical support 126, or removably-attached via a fastener 170. The fastener 170 is any fastener or fastening system known in the art, such as but not limited to: nuts, bolts, screws, washers, etc.

It is further contemplated that in lieu of using an existing oar holder 36 of a boat 30, the device 100 may have its own oar holder that functions in the same manner as the oar holder 36 described above and is of the same architecture as the oar holder 36 shown in the FIGS. Alternatively, a user can use any traditional fastener known in the art such as a nut, bolt, screw, etc., to secure the bracket 130 to the top surface 34 of a boat 30 through the opening 132, or to any surface 32, 34 of a boat 30 that is not comprised of any oar holders 36. In a further embodiment, a continuous opening 132 may be additionally or alternatively present on the vertical support 126 to allow a user to use a fastener 170 to secure the vertical support, wheel assembly 126, 110 to the side surface 32 of a boat 30 in a more permanent manner. Further, an opening 132 may also be found on the bracket 130 to allow a user to secure the bracket 130 to the vertical support 126 and to the side surface 32 of a boat 30.

Figure 5:
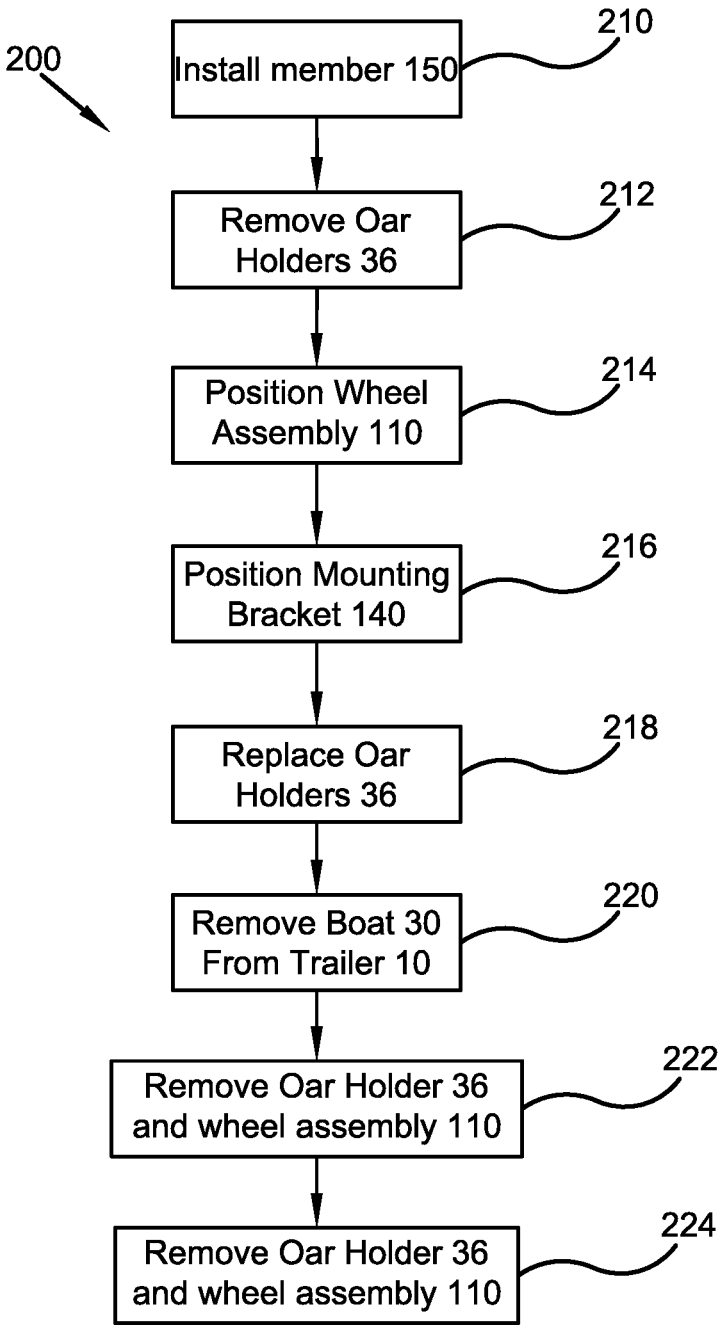
FIG. 5 illustrates a flow chart of one potential method of using one potential embodiment of a boat transport device or personal boat handling carrier to move a boat that is being stored on a trailer in accordance with the disclosed architecture.

FIG. 5 illustrates a flow chart of one potential method 200 of using one potential embodiment of a boat transport device to move a boat 30 that is being stored on a trailer 10 in accordance with the disclosed specification. The device 100 may also have a method 200 of using the boat transport device 100 to move a boat 30 from a trailer 10. However, it should be appreciated that this method 200 can also be followed to allow a user to remove a boat 30 from a vehicle bed or other carrier that it is being stored on, using the identical process described in the method 200. First, at least one boat-mounted bracket member 150 is installed on at least the two opposing side surfaces 32 of the boat (Block 210). Then, both oar holders 36 (if the boat 30 contains oar holders 36) are removed (Block 212). In the event oar holders are not provided, the owner of the boat may create openings in the hull, sidewalls or rails in order to allow the invention to be affixed to the boat. Next, the wheel assembly 110 is positioned on each side of the boat 30, such that the continuous opening 132 of the horizontal bracket 130 is positioned above the opening (not shown) in the top surface 34 of the boat 30 that receives each oar holder 36 (Block 214). Then, the mounting bracket 140 is positioned such that the cylindrical protrusion 152 contacts the bottom of the cutout 144 (Block 216). However, these two steps (Block 214, Block 216) may be done in the opposite order (e.g. the step of Block 216 is performed first) in one embodiment of the method 200. Next, the oar holders 36 are replaced, such that the shafts 38 of the oar holders 36 are fed through the continuous opening 132 of each bracket 130 and the wheel assembly 110 is secured to the boat 30 (Block 218). Then, the boat 30 can be picked up and removed/pushed/pulled from a trailer 10 to a desired location, wherein the wheel 160 of each wheel assembly 110 contacts the ground (Block 220). It should be noted that this method 200 may be used to remove a boat 30 from other positions/locations besides a trailer 10 such as within the bed of a pickup truck/vehicle, on a boat rack of a vehicle, or on any other carrying/transporting surface of the like. After the boat 30 has reached the desired location, one oar holder 36 can be removed and after tilting the boat 30 to one direction, the force of gravity and downward pressure from the user can be used to free the wheel assembly 110 from the boat-mounted bracket member 150 to allow the assembly 110 to be removed (Block 222). Finally, the previous step can be repeated to remove the other assembly 110 from the other side 32 of the boat 30 to allow the boat 30 to be used as normal (Block 224).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "boat transport device" and "device" are interchangeable and refer to the boat transport device 100 of the present invention.

Notwithstanding the forgoing, the boat transport device 100 of the present invention and its various components can be of any suitable size and configuration as is known in the art without affecting the overall concept of the invention, provided that they accomplish the above-stated objectives. One of ordinary skill in the art will appreciate that the size, configuration and material of the boat transport device 100 as shown in the FIGS. are for illustrative purposes only, and that many other sizes and shapes of the boat transport device 100 are well within the scope of the present disclosure. Although the dimensions of the boat transport device 100 are important design parameters for user convenience, the boat transport device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A carrier assist for moving a boat, the carrier assist comprising:
   - a wheel comprising an axle;
   - a boat mounting member attachable to a side of the boat and comprising a removably attachable cylindrical protrusion;
   - a wheel assembly comprising a horizontal cross member, a pair of forks extending downward from the horizontal cross member and spaced apart to accommodate the wheel between the pair of forks, a vertical support extending upward from the horizontal cross member, and a horizontal bracket extending from the vertical support and comprising an opening configured to fit over and engage a shaft of an oar holder bracket of the boat; and
   - a mounting bracket attachable to one of the pair of forks and comprising a sidewall comprising a cutout contoured to receive the removably attachable cylindrical protrusion of the boat mounting member.

2. The carrier assist for moving a boat as recited in claim 1, wherein the boat is one of a rowboat, a canoe, a kayak, a sailboat, a paddle boat or a catamaran.

3. The carrier assist for moving a boat as recited in claim 1, wherein the carrier assist is removably mounted to the boat.

4. The carrier assist for moving a boat as recited in claim 1, wherein the mounting bracket extends perpendicularly to the pair of forks.

5. The carrier assist for moving a boat as recited in claim 1, wherein the carrier assist utilizes gravity for removal of the carrier assist from the boat.

6. The carrier assist for moving a boat as recited in claim 1, wherein a portion of the wheel is positioned below a bottom of the boat.

7. A boat and carrier assist combination comprising:
   - a boat selected from a group comprising a rowboat, a canoe, a kayak, a sailboat, a paddle boat or a catamaran, wherein the boat is comprised of a first sidewall, a second sidewall and a top surface above each of the first and second sidewalls
   - a carrier assist comprising:
     - a wheel comprising an axle;
     - a pair of boat mounting members attachable to the first sidewall of the boat and each comprising a removably attachable cylindrical protrusion;
     - a wheel assembly comprising a horizontal cross member, a pair of forks extending downward from the horizontal cross member and spaced apart to accommodate the wheel between the pair of forks, a vertical support extending upward from the horizontal cross member, and a horizontal bracket extending from the vertical support and comprising an opening configured to fit over and engage a shaft of an oar holder bracket of the boat; and
     - a mounting bracket attachable to one of the pair of forks and comprising a sidewall comprising a pair of cutouts each contoured to receive the removably attachable cylindrical protrusion of one of the boat mounting members.

8. The boat and carrier assist combination as recited in claim 7 further comprising a second carrier assist that is secured to the second sidewall of the boat opposite the first sidewall.

9. The boat and carrier assist combination as recited in claim 7, wherein each boat mounting member is removably secured to the first sidewall of the boat by a fastener.

10. The boat and carrier assist combination as recited in claim 9, wherein each boat mounting member is removed from the first sidewall of the boat by removal of the fasteners.

11. A boat transport device comprising:

a boat having first and second sidewalls;

first and second transports, wherein the first transport is removably attached to the first sidewall and the second transport is removably attached to the second sidewall; and wherein each transport comprises:

a wheel comprising an axle;

a boat mounting member attachable to the respective sidewall of the boat and comprising a removably attachable cylindrical protrusion;

a wheel assembly comprising a horizontal cross member, a pair of forks extending downward from the horizontal cross member and spaced apart to accommodate the wheel between the pair of forks, a vertical support extending upward from the horizontal cross member, and a horizontal bracket extending from the vertical support and comprising an opening configured to fit over and engage a shaft of an oar holder bracket of the boat; and a mounting bracket extending perpendicularly from and attachable to one of the pair of forks and comprising a bracket sidewall comprising a cutout contoured to receive the removably attachable cylindrical protrusion of the respective boat mounting member.

12. The boat transport device as recited in claim 11, wherein each mounting bracket positions each wheel so that at least a portion of each wheel is below a bottom surface of the boat.

* * * * *